United States Patent [19]

Höfer et al.

[11] Patent Number: 4,512,308

[45] Date of Patent: Apr. 23, 1985

[54] DEVICE FOR ADJUSTING THE FULL-LOAD INJECTION QUANTITY OF A FUEL INJECTION PUMP FOR INTERNAL COMBUSTION ENGINES

[75] Inventors: Gerald Höfer, Weissach-Flacht; Max Straubel; Franz Eheim, both of Stuttgart, all of Fed. Rep. of Germany

[73] Assignee: Robert Bosch GmbH, Stuttgart, Fed. Rep. of Germany

[21] Appl. No.: 425,816

[22] Filed: Sep. 28, 1982

[30] Foreign Application Priority Data

Nov. 21, 1981 [DE] Fed. Rep. of Germany ..... 3146132

[51] Int. Cl.[3] ..... F02D 1/06

[52] U.S. Cl. ..... 123/383; 123/387

[58] Field of Search ..... 123/383, 382, 380, 387, 123/503

[56] References Cited

U.S. PATENT DOCUMENTS 3,726,263 4/1973 Kemp ..... 123/383
4,308,834 1/1982 Eheim ..... 123/383
4,384,560 5/1983 Jager et al. ..... 123/501

FOREIGN PATENT DOCUMENTS 37572 3/1980 Japan ..... 123/449
41429 4/1981 Japan ..... 123/383
188730 11/1982 Japan ..... 123/502

*Primary Examiner*—Magdalen Y. C. Moy
*Attorney, Agent, or Firm*—Edwin E. Greigg

[57] ABSTRACT

A fuel injection pump in which the quantity adjustment member has a travel limitation in the form of an adjustable stop, which is adjusted in accordance with the displacement of an adjusting piston in accordance with a contour defined on the adjusting piston. The displacement of the adjusting piston is effected with the rpm-dependent pressure of the suction chamber of the fuel injection pump, and the work chamber preceding the adjusting piston can be uncoupled from the suction chamber via a throttle. The maximum displacement of the adjusting piston is limited by a stop which is adjustable in accordance with charge pressure or by a pressure control device by means of which the pressure in the work chamber can be adjusted or limited.

15 Claims, 4 Drawing Figures

DEVICE FOR ADJUSTING THE FULL-LOAD INJECTION QUANTITY OF A FUEL INJECTION PUMP FOR INTERNAL COMBUSTION ENGINES

BACKGROUND OF THE INVENTION

The invention is based on a fuel injection pump of the type described hereinafter and finally claimed. In an injection pump known from German Offenlegungsschrift 28 54 422, the full-load injection quantity is limited with the aid of an adjustable stop against which the fuel quantity adjusting member comes to rest at full load. This stop is adjustable in accordance with the pressure of the air delivered to the combustion chambers of the engine, e.g., the charge pressure in the case of supercharged engines. To this end, a pressure box exposed to the charge pressure displaces an adjusting piston provided on its jacket with a contour which is scanned mechanically in order to adjust the stop. In this manner, the fuel injection quantity is adapted to the delivered air quantity. A purely charge-pressure-dependent correction of the injection quantity such as this has the disadvantage that it can follow dynamic load changes only relatively slowly; this is particularly true in the case of devices for compressing the aspirated air which are driven by exhaust gas, because the change in volume of the exhaust gas follows a change in fuel quantity only in a delayed manner. In order to fix the maximum fuel injection quantity at full load, one significant factor in addition to the charge pressure is the rpm. The characteristic fuel supply curves of a supercharger driven by the engine, where the supply pressure is in accordance with the injected fuel quantity, have a successively decreasing slope as the rpm increases. This permissible fuel injection quantity of the supercharged engine also increases with increasing rpm. However, the inclination of the adaptation curve characterizing this permissible fuel quantity has a substantially lower slope than does the slope of the supply curves of the engine/supercharger combination. Thus an error in adjustment which may have arisen at low rpm becomes considerably greater with increasing rpm, which is disadvantageous.

In another known fuel injection pump, disclosed in German Offenlegungsschrift No. 28 47 572, in order to avoid this error, a three-dimensional cam is displaced on the one hand by the rpm-dependent suction-chamber pressure of the injection pump and rotated on the other in accordance with charge pressure. Again, a pressure box exposed to charge pressure is used as the adjusting member, and the three-dimensional curve on the three-dimensional cam is scanned mechanically and transferred to the full-load stop. This has the disadvantage, however, that because of the friction involved in the scanning process, and especially because of the transmission of the governing-spring force onto the scanning pin via the full-load stop, errors of hysteresis occur in adjusting the full-load quantity. Furthermore, the torque which the adjusting box is capable of exerting is quite low, given reasonable dimensions for the adjusting box. Thus, an incorrect adjustment will become magnified with increasing rpm in this form of embodiment as well, because of that portion of the input to the maximum fuel injection quantity which is derived from the charge pressure.

OBJECT AND SUMMARY OF THE INVENTION

It is a principal object of the fuel injection pump according to the invention and having the advantage over the prior art that within the limits set by the charge pressure, the adjustment of the full-load injection quantity is effected in an rpm-dependent manner.

It is another object of the invention that adjustment based upon this variable can be blocked in the event that there is no charge pressure.

It is a further object that only upon the emergence of a charge pressure is the adjustment for increasing the fuel injection quantity with increasing rpm permitted, and the adjustment is in proportion with the increase in the charge pressure.

It is a still further object that that portion of the adjustment which is directly dependent upon the charge pressure not be subjected to any mechanical forces which could cause hysteresis.

It is yet another object to provide that progressively greater tolerance caused by increasing rpm within the direct, charge-dependent adjustment is avoided. In summary, there is virtually no notable hysteresis allowed by the invention given the purely hydraulic adjustment and the high capacity for work associated with adjustment of the injection quantity.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
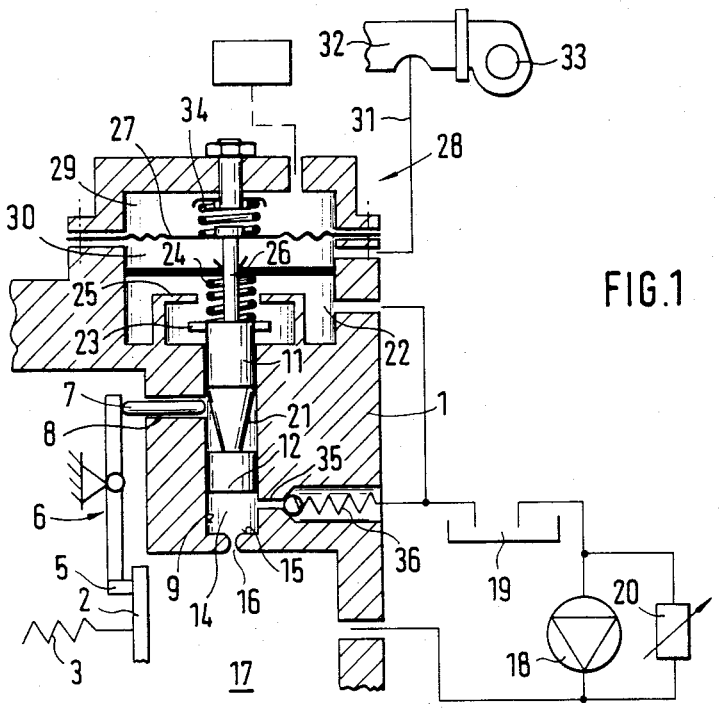
FIG. 1 is a fragmentary view of a first exemplary embodiment of the invention showing a mechanical unlocking means for the rpm-dependent adjustment of the adjusting piston.

FIG. 1 shows a portion of a fuel injection pump, which may for instance be a distributor injection pump. In a known manner, this pump has a fuel quantity adjusting member 2 embodied as a lever, which actuates an annular slide, not otherwise shown, for controlling the fuel injection quantity. The fuel quantity adjusting member 2, which is adjustable counter to a governor spring apparatus 3, rests in the full-load position against an adjustable stop 5. In this embodiment the adjustable stop 5 is at the end of a rocker 6, the other end of which rests on a scanning pin 7. The scanning pin 7 is guided in a bore 8 and protrudes at right angles into a cylinder 9 disposed in the housing. An adjusting piston 11 is tightly guided within this cylinder 9 and on one end face 12 encloses a work chamber 14 within the cylinder 9. The work chamber 14 communicates continuously, via a throttle bore 16 located at the end face 15 of the cylinder 9, with a chamber filled with a pressure medium, the pressure of which is controlled in accordance with rpm. In this exemplary embodiment, this chamber is the fuel-filled suction chamber 17 of the fuel injection pump, and, it is supplied with fuel by a fuel pump 18 which pumps fuel from a fuel container 19, the supply side of which can be relieved via a pressure control valve 20. Because of this disposition, an rpm-dependent pressure is established in the suction chamber 17 in a known manner.

The adjusting piston 11 has a contour 21 which resembles the frustrum of a cone on its jacket face in the vicinity of the point of entry of the scanning pin 7 into the cylinder 9, and the position of the scanning pin relative to the rocker 6 depends upon the displacement of the adjusting piston which is determined by means of this contour 21. The cylinder 9 discharges at the end remote from the work chamber 14 into a chamber 22 provided with a spring 24 which acts counter to adjusting piston 11 into which the other end face 23 of the adjusting piston 11 protrudes. The other end face 23 has a larger diameter than the diameter of the cylinder 9 and is stressed by the adaptation spring 24, which is supported on the opposite side of the spring chamber 22. The adjusting path of the adjusting piston 11 is thereby limited by means of a stop 25 formed by the housing and disposed in the spring chamber 22, against which the end face 23 abuts when the adaptation spring is compressed.

Also protruding into the spring chamber 22, coaxially with the adaptation spring 24 and the adjusting piston 11 is an adjustable stop pin 26, which is guided tightly by the wall of the spring chamber and is firmly connected with an adjusting diaphragm 27 of an adjusting device 28. The adjusting device 28 comprises a pressure box, and the adjusting diaphragm 27 divides a reference pressure chamber 29 from a control pressure chamber 30. The reference pressure chamber 29 may communicate with the ambient air, for example, while the control pressure chamber 30 communicates via a control pressure line 31, for example, with the intake system 32 of an internal combustion engine driven with the fuel injection pump downstream of a supercharger 33. In another embodiment, the control pressure chamber may be charged with a constant pressure in order to detect pressure fluctuations in the ambient air. Via the adjusting device, the gas pressure of the air supplied to the combustion chambers of the engine is then compared with this constant pressure. The adjusting diaphragm 27 is preferably acted upon by a restoring spring 34 disposed in the reference pressure chamber 29; this spring 34 may also comprise means for adjustability thereof.

In a further, supplementary embodiment the work chamber 14 can be relieved toward the supply container 19 via a relief line 35, in which a pressure maintenance valve 36 is disposed.

When the above-described fuel injection pump is operated together with an internal combustion engine which has a supercharger, the adjusting piston 11 is subjected to the pressure prevailing in the work chamber 14, which pressure has an rpm-dependent force. At the onset of operation, the air pressure in the intake tube is still too low to deflect the adjusting diaphragm 27 counter to the force of the spring 34. The adjustable stop pin 26 is thus pressed by the spring force against the adjusting pin 11, which in turn is held in the outset position under the influence of the adaptation spring 24. The full-load stop 5 is accordingly located in a position which corresponds to a small full-load fuel injection quantity. With increasing rpm, the pressure in the intake line increases as well, and the adjustable stop 26 is increasingly retracted counter to the force of the restoring spring 34. By means of the hydraulic pressure in the suction chamber 17 or the work chamber 14, which is simultaneously increasing as well, the adjusting piston 11 can now execute an adaptive displacement counter to the force of the adaptation spring 24. The scanning pin 7 thereupon tracks the contour 21 and moves still farther into the cylinder 9, so that the stop 5 also moves through successive positions corresponding to greater full-load fuel injection quantities. With increasing rpm, the adjusting piston 11 is thus displaced farther, in order either to increase the full-load injection quantity, or to adjust it, to such an extent that the movable stop 26 leaves the adaptation path open. The maximum deflection of the adjusting piston 11 is thus limitable, for example, by the fixed stop 25. Beyond a predetermined rpm, no further change in the full-load injection quantity takes place.

A limitation of the adjustment of the adjusting piston 11 can also be effected hydraulically, with the aid of the pressure maintenance valve 36. This valve opens toward the relief side beyond a predetermined established pressure, so that, uncoupled from the effect of the throttle 16, it is not possible for a higher pressure to be built up in the work chamber 14. Therefore, no further change in the full-load injection quantity takes place, regardless of any further increase in the charge pressure.

Figure 2:
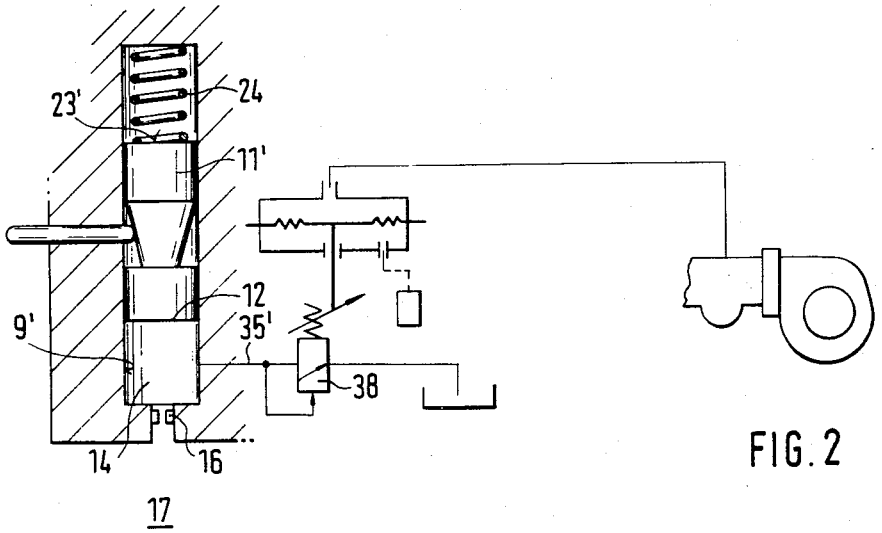
FIG. 2 is another fragmentary view of a second embodiment of the invention showing a hydraulic, charge-pressure-dependent limitation of the pressure acting upon the adjusting piston.

A modified form of the embodiment of FIG. 1 is shown in FIG. 2. Here, a substantially identical adjusting piston 11' is provided, having one end face 12 enclosing the work chamber 14 within a closed cylinder 9'. The work chamber 14 communicates via the throttle bore 16 with the suction chamber 17. The adjusting piston 11' is displaceable counter only to the force of the adaptation spring 24, which acts upon another end face 23'. Instead of the travel-limiting device of the adjusting piston 11 of the embodiment of FIG. 1, the embodiment of FIG. 2 has a relief line 35', in which a pressure limiting valve 38 is disposed. The opening pressure of this pressure limiting valve is adjustable in accordance with the pressure of the air delivered to the combustion chambers of the engine.

In this embodiment, as in the previous exemplary embodiment, the adjusting piston 11' is adjusted in accordance with rpm. The maximum level of the adjusting pressure in the work chamber 14 is controlled in accordance with charge pressure with the aid of the pressure limiting valve, so that the extent of adjustment is limitable by means of the charge pressure. The pressure limiting valve 38 may advantageously by embodied such that it permits only a predetermined, upper limiting pressure to be established in the work chamber 14, again independently of the level of the charge pressure.

Figure 3:
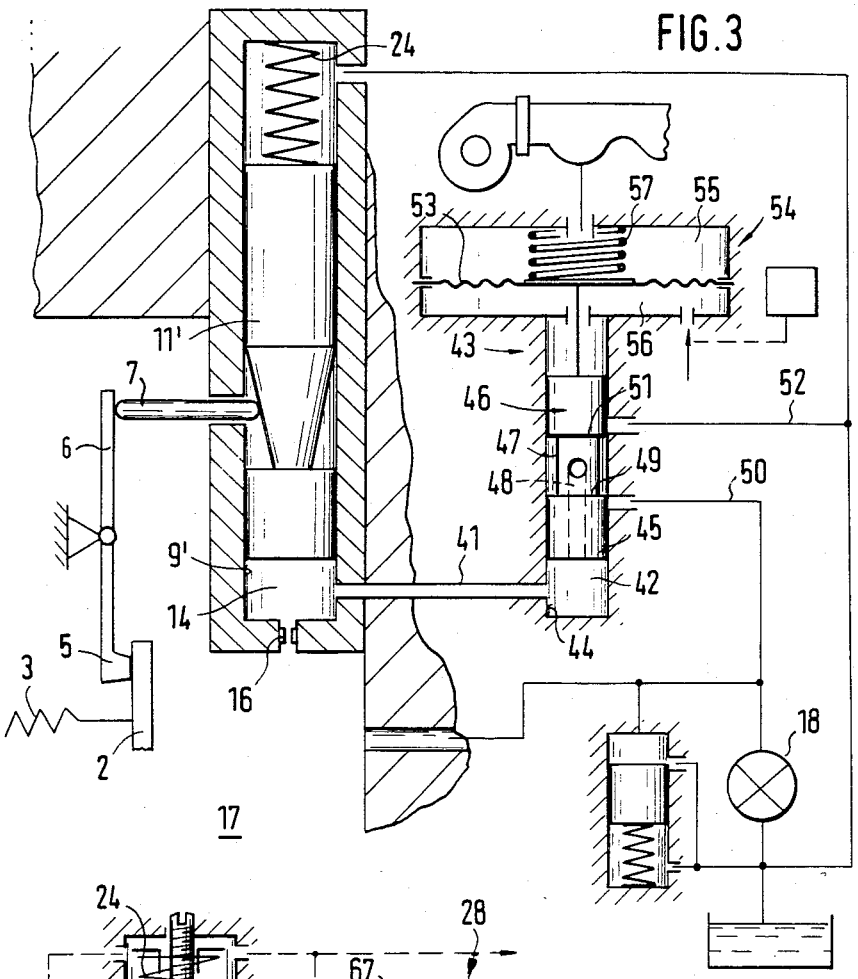
FIG. 3 is a fragmentary view of a third exemplary embodiment revealing a variant structure for the hydraulic limitation of the adjustment of the adjusting piston.

The exemplary embodiment of FIG. 3 corresponds substantially to the exemplary embodiment of FIG. 2 and relates to an apparatus for the charge-pressure-dependent control of the pressure in the work chamber 14. The adjusting piston 11', as in the foregoing embodiment, encloses the work chamber 14 within the cylinder 9' and is displaceable counter to the force of the adaptation spring 24. The work chamber 14 communicates via the throttle 16 with the suction chamber 17. A pressure line 41 furthermore leads out of the work chamber 14, discharging into a pressure chamber 42 of a pressure control valve 43. This valve which resembles the known spool-valve includes within a cylinder 44, a control piston 46 having one end face 45, which piston is tightly displaceable in the cylinder and provided with an annular groove 47, which communicates continuously via a bore 48 in the control piston 46 with the pressure chamber 42. The limiting edges of the annular groove 47 comprise a first control edge 49 and a second control edge 51; the first control edge 49 being arranged to control the mouth of a pressure medium supply line 50, which begins at the fuel pump 18 and leads into the cylinder 44. The second control edge 51 controls the opening of a relief line 52 which exits from the cylinder 44.

The control piston 46 is connected with an adjusting diaphragm 53, which is disposed within a pressure box 54 to divide a control pressure chamber 55 from a reference pressure chamber 56. The adjusting diaphragm 53 is also stressed by a restoring spring 57. The control pressure chamber 55 is exposed to the pressure of the air to be delivered to the combustion chambers, while either atmospheric pressure or a constant reference pressure prevails in the reference pressure chamber 56.

When the control piston 46 assumes a medial position within cylinder 44, the two control edges 49 and 51 close the pressure medium supply line 50 and the relief line 52. In this balanced position, the work chamber 14 communicates with the suction chamber 17 only via the throttle bore 16.

When the fuel injection pump of the internal combustion engine is put into operation, the control piston 46 is displaced downward by the force of the restoring spring 57 since the pressure in the work chamber 14 is still lacking, so that the pressure chamber 42 communicates with the pressure medium supply line 50. With increasing pressure in the suction chamber, the hydraulic restoring force acting upon the control piston 46 increases, so that this piston 46 is displaced upward, counter to the force of the restoring spring 57, and the pressure medium supply line 50 is closed. With increasing suction chamber pressure, the pressure in the work chamber 14 also continues to increase because of the throttle connection between the work chamber 14 and the suction chamber 17. This increase permits an adjustment of the adjusting piston 11', until because of the pressure increase the control piston 46, with its second control edge 51, opens the relief line 52. With increasing rpm, however, the air pressure in the intake system of the supercharged engine also increases, so that increasing stress is exerted on the control piston. In accordance with this force, the pressure in the pressure chamber 42 and in the work chamber 14 can also increase.

In this exemplary embodiment as well, the charge pressure acts indirectly upon the adjustment of the adjusting piston 11', which is subjected to the mechanical scanning forces. The adjustment of the piston itself is effected hydraulically, and the maximum adjusting pressure is limited by the described device in accordance with charge pressure.

Figure 4:
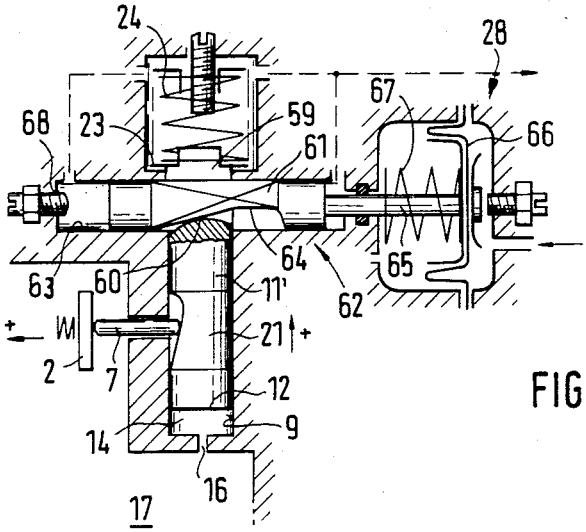
FIG. 4 shows in a fragmentary view a fourth exemplary embodiment of the invention.

In FIG. 4, a variant of the exemplary embodiment of FIG. 1 is shown. This variant differs from the embodiment of FIG. 1 substantially in terms of the embodiment of the stop 26. Here again, an adjusting piston 11' is provided displaceably disposed in a cylinder 9, and which cylinder and a first end face 12 defines a work chamber 14 which communicates via a bore 16 with the pressure source, that is, with the suction chamber 17. The contour 21 on the adjusting piston 11' is scanned by means of the pin 7 and transmitted to the rocker 6 (not shown); or it is also possible, for instance, for it to be transmitted directly onto the quantity adjusting device 2. This latter is possible particularly if only slight forces are exerted upon the quantity adjusting device 2. A second end face 23 of the adjusting piston is stressed by the spring 24, which is attached at one end to the housing in an adjustable manner. Differing from the first exemplary embodiment shown in FIG. 1, the adjusting piston 11' here is provided with a cutaway slit 59 extending inwardly from the second end face 23, which cutaway slit is provided with a base oriented toward the second end face 23, which base is spherically shaped to serve as a scanning cam 60.

A rib-like medial portion 61 of an adaptation piston 62 protrudes all the way through the slit 59, transversely with respect to the adjusting piston 11'. The cylindrical ends of the adaptation piston 62 are guided within a bore 63. On a side oriented toward the scanning cam 60, the rib-like medial portion furthermore has a contour 64, which limits the deflected position of the adjusting piston 11' counter to the restoring spring 24. An adjustment spring 67 is connected via a piston rod 65 with an adjusting diaphragm 66, which similarly to the adjusting diaphragm 27 of the exemplary embodiment shown in FIG. 1, is exposed on one side to a reference pressure and on the other side to a pressure corresponding to the density of the air supplied to the combustion chambers of the engine. The adjusting diaphragm 66 is furthermore stressed by the adjusting spring 67, which urges the adaptation piston 62 into a position which corresponds to the outset position of the adjusting piston 11'. Alternatively, this adjusting spring may naturally also engage the end of the adaptation piston 62 located opposite the connection with the piston rod 65. The adaptation piston 62 further has an adjustable stop 68, which limits the displacement path of the adaptation piston counter to the force of the adjusting spring 67. The adjustable stop 68 can also determine the position of the adjusting piston 11' via contour 64 and the limit of piston 11' displacement counter to the restoring spring 24. This embodiment has the advantage that relatively small forces are required for displacing the adaptation piston, and the adjusting device 28' having the adjusting diaphragm 68 can be kept relatively small in size.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A device for adjusting the full load injection quantity of a fuel injection pump for internal combustion engines including a fuel quantity adjusting member arranged to traverse a travel and means associated therewith for varying said travel which comprises:

an injection pump housing;

a piston chamber in said injection pump housing;

an adjusting piston in said piston chamber;

a restoring spring positioned relative to and operative to apply a counterforce on one end of said adjusting piston;

a pressure source which is varied according to rpm;

a work chamber defined by one end of said piston and said piston chamber which communicates with said pressure source to provide a fluid under pressure in said work chamber according to rpm of said fuel injection pump against said counterforce on one end of said adjusting piston;

transmission means operatively related to said adjusting piston and to said means for varying said travel for adjusting said means relative to any movement of said adjusting piston in said piston chamber, and means for restricting travel of said adjusting piston in accordance with operating parameters of said combustion engine including the density of air delivered to said combustion engine.

2. A device for adjusting the full load injection quantity of a fuel injection pump according to claim 1, in which:

said means for restricting displacement of said adjusting piston includes a stop means which engages one end of said piston, and said stop means is adjustable in accordance with operating parameters of said combustion engine.

3. A device for adjusting the full load injection quantity of a fuel injection pump according to claim 2, which includes:

an adjusting member of said stop means subjected to a restoring force spring, said adjusting member having one surface exposed to a reference pressure and another surface exposed to a control pressure, said control pressure corresponding to the pressure of the air delivered to the combustion engine, and said adjusting member is adjustable by means of the pressure difference between said reference pressure in collaboration with said restoring force spring and said control pressure.

4. A device for adjusting the full load injection quantity of a fuel injection pump according to claim 3, in which said stop means rests against said adjusting piston in its initial position and retains said adjusting piston in its initial position with the assistance of said restoring spring.

5. A device for adjusting the full load injection quantity of a fuel injection pump according to claim 3, which includes:

a fixed stop means which limits a maximum displacement travel of said adjusting piston counter to said restoring spring.

6. A device for adjusting the full load injection quantity of a fuel injection pump according to claim 3, in which:

said work chamber includes a throttle bore which communicates with said pressure source, and a pressure maintenance valve which communicates with said work chamber and with a relief chamber.

7. A device for adjusting the full load injection quantity of a fuel injection pump according to claim 1, in which:

said work chamber includes a throttle bore which communicates with said pressure source, a control valve, a relief chamber, said control valve communicating with said work chamber and said pressure relief chamber, and said control valve is controllable in accordance with operating parameters of said engine including the density of the air delivered to said combustion engine.

8. A device for adjusting the full load injection quantity of a fuel injection pump according to claim 7 wherein:

said control valve comprises a pressure limiting means and further that a point at which said control valve opens is variable in accordance with operating parameters.

9. A device for adjusting the full load injection quantity of a fuel injection pump according to claim 7 wherein:

said control valve comprises a pressure control means whereby a pressure is maintainable in accordance with operating parameters of said engine.

10. A device for adjusting the full load injection quantity of a fuel injection pump according to claim 9 in which:

said pressure control means includes a cylinder having a closed end, a control piston in said cylinder, a pressure chamber formed in one end of said control piston and said closed end of said cylinder which communicates with said work chamber, said control piston including an annular groove which forms upper and lower control edges, a bore in said piston which extends from said pressure chamber in said cylinder to said annular groove in said piston, a pressure medium supply line connected to said cylinder, a pressure relief line connected to said cylinder, said pressure medium supply line and said pressure relief line are connected to said cylinder and controlled by said upper and lower control edges on said control piston for communication with said pressure chamber via said bore in said piston such that at a fixed position of said control piston both said pressure medium supply line and said relief line may be closed simultaneously by said control edges, means that applies a control force onto said control piston counter to a fluid pressure force in said pressure chamber in which a portion of said control force applied by said means corresponds to the density of air delivered to the combustion engine.

11. A device for adjusting the full load injection quantity of a fuel injection pump according to claim 10 in which:

said control piston is exposed to a basic force exerted in the same direction as the control force.

12. A device for adjusting the full load injection quantity of a fuel injection pump according to claim 3 which includes:

an adjusting member, said adjusting member including a contoured portion, and said stop means comprises an adaptation piston which is displaceable transversely to the displacement direction of said adjusting piston by said adjusting member, against which said adjusting piston is made to rest by means of the rpm-dependent pressure acting upon said piston.

13. A device for adjusting the full load injection quantity of a fuel injection pump according to claim 12 in which:

said adjusting piston has a slit on its end oriented toward said restoring spring, which is parallel to its jacket face, and said adaptation piston is flattened, in a functional vicinity of an overlap with said adjusting piston in a manner that is adapted to the width of said slit.

14. A device for adjusting the full load injection quantity of a fuel injection pump according to claim 12 in which:

said adaptation piston is provided with a restoring spring, and the maximum displacement travel of the adaptation piston counter to said restoring spring is limited by a stop means.

15. A device for adjusting the full load injection quantity of a fuel injection pump according to claim 12, in which:

said work chamber communicates with said pressure source via said throttle bore and may be made to communicate with the relief side via said pressure maintenance valve.

* * * * *